US006273272B1

(12) United States Patent
Hake

(10) Patent No.: US 6,273,272 B1
(45) Date of Patent: Aug. 14, 2001

(54) SKI STORAGE DEVICE

(76) Inventor: Garry D. Hake, P.O. Box 443, Emigsville, PA (US) 17318

( * ) Notice: Subject to any disclaimer, the term of this patent is extended or adjusted under 35 U.S.C. 154(b) by 0 days.

(21) Appl. No.: 09/359,033

(22) Filed: Jul. 23, 1999

Related U.S. Application Data

(60) Provisional application No. 60/094,641, filed on Jul. 30, 1998.

(51) Int. Cl.[7] ..... E05B 73/00; E05B 69/00; A47F 7/00

(52) U.S. Cl. ..... 211/4; 211/70.5; 70/58; D6/552

(58) Field of Search ..... 211/4, 70.5; 70/58, 70/57, 62, 99, 100, 451, 461, 466; D6/552

(56) References Cited

U.S. PATENT DOCUMENTS

| | | | | |
|---|---|---|---|---|
| Re. 35,677 | * | 12/1997 | O'Neill | 248/551 |
| 2,831,335 | * | 4/1958 | Kidd et al. | 70/58 |
| 2,956,813 | * | 10/1960 | Madden | 280/11.37 |
| 3,568,902 | | 3/1971 | Highberger . | |
| 3,570,681 | * | 3/1971 | Kinshofer | 211/70.5 |
| 3,664,616 | * | 5/1972 | Raskin | 248/25 |
| 3,776,437 | * | 12/1973 | Carney | 224/42.45 R |
| 3,854,641 | * | 12/1974 | Kohls | 224/29 R |
| 3,874,202 | * | 4/1975 | Effenheim | 211/70.5 X |
| 4,033,460 | * | 7/1977 | Alexandre | 211/70.5 |
| 4,084,867 | | 4/1978 | Putt et al. . | |
| 4,143,799 | * | 3/1979 | Dietlein et al. | 224/301 |
| 4,222,490 | * | 9/1980 | Wood, Jr. | 211/70.5 |
| 4,230,248 | * | 10/1980 | Finnegan | 224/323 |
| 4,231,501 | * | 11/1980 | Goode | 224/42.46 R |
| 4,391,376 | * | 7/1983 | Finnegan | 211/70.5 |
| 4,508,229 | * | 4/1985 | Yost, Jr. | 211/70.5 |
| 4,705,177 | * | 11/1987 | Oren | 211/70.5 |
| 4,778,065 | | 10/1988 | Chiarot . | |
| 4,830,403 | * | 5/1989 | Ohmori | 211/70.5 X |
| 4,988,007 | | 1/1991 | Chiarot . | |
| 5,082,224 | * | 1/1992 | Hayward | 248/224.3 |
| 5,147,049 | | 9/1992 | Schwendemann et al. . | |
| 5,165,265 | * | 11/1992 | Maionchi | 70/232 |
| 5,183,164 | * | 2/1993 | Heinzle | 211/70.5 |
| 5,193,694 | * | 3/1993 | Wave | 211/70.5 |
| 5,417,335 | | 5/1995 | White . | |
| 5,538,137 | | 7/1996 | Deioma et al. . | |
| 5,560,497 | * | 10/1996 | Mulvihill, Jr. | 211/4 |
| 5,979,846 | * | 11/1999 | Fluhr | 248/200 |

* cited by examiner

*Primary Examiner*—Blair M. Johnson
*Assistant Examiner*—Khoa Tran
(74) *Attorney, Agent, or Firm*—Nixon Peabody LLP; Tim L. Brackett, Jr.; Daniel S. Song

(57) ABSTRACT

A ski storage device including a back plate adapted to be mounted to an attachment surface, a first side panel outwardly extending away from the back plate, a second side panel outwardly extending away from the back plate and being positioned a spaced transverse distance from the first side panel thereby forming a substantially U-shape with a transverse gap between the side panels thereby forming a transverse opening for receiving skis to be stored in the transverse gap. The first and second side panels are adapted to be adjusted between a retracted position and an elongated position, and at least one of the first and second side panels is adjustably secured to the back plate to thereby allow adjustment of the transverse gap.

14 Claims, 5 Drawing Sheets

SKI STORAGE DEVICE

This application is based on provisional application Ser. No. 60/094,641, filed Jul. 30, 1998.

BACKGROUND OF THE INVENTION

1. Field of the Invention

The present invention is related to the field of storage devices for skis. More specifically, the invention relates to ski storage devices which include locks for preventing theft of the skis.

2. Description of Related Art

The recreational sports such as downhill and cross country skiing have increased in popularity in recent times as more individuals and families enjoy increased economic prosperity. Correspondingly, the sales of skis and skiing equipment have also dramatically increased as more and more skiers purchase their own skis and equipment rather than renting them. With more skiers owning their own equipment, there has developed a need for a storage device which can store the skis in an efficient and cost effective manner. This need has been recognized especially since skiing is a seasonal sport and are generally not used year round. Although numerous devices for storing snow skis have been developed in the art it has been found that skis are difficult store securely due to their cumbersome elongated shapes.

For instance, U.S. Pat. No. 4,084,867 to Putt et al. discloses a storage cabinet in which skis may be vertically suspended by the curved tips between two knobs. U.S. Pat. No. 5,417,335 to White also discloses a device for suspending a pair of skis between two rotating arms. However, because these storage devices have been designed for conventional snow skis, these storage devices as well as other devices known in the art, are inadequate in storing the various types of other snow skis which have a slightly different shape, thickness and width. As ski equipment manufacturers continue to improve and diversify their product lines with additional features to provide superior quality and performance, various skis of different shapes, widths and thicknesses are now commonly used including standard skis, cross country skis, shaped (parabolic) skis, "Fat Boys", ski skates and ski boards, etc. Thus, the prior art storage devices have been found to be inadequate in storing skis of different shapes and dimensions. Furthermore, these prior art storage devices have been found to be inadequate due to the changing needs in the field of ski storage.

In particular, the increase in consumer demand as well as the improved quality and performance of skis have resulted in the increasing prices of such equipment. Correspondingly, theft of such equipment has also increased, especially in higher end expensive ski equipment. The ski storage devices of the '867 patent and the '335 patent do not provide any protection from theft of the skis stored thereon. Also, the skis may be easily removed and taken by a thief.

In response, various devices have been made for lockably securing skis to prevent such thefts. U.S. Pat. No. 4,988,007 to Chiarot discloses a wall mountable modular ski rack in which the skies are vertically suspended by the curved tips of the skies. The reference further discloses a plug member to retain the skis in the module and that a lock may be used to prevent the removal of the plug member. However, like the devices of the '867 and '355 patents discussed above, the modular ski rack of the '007 patent cannot adequately secure different types of skis noted above which have different shapes and dimensions. Moreover, even when a lock is used with the device of the '007 patent, the skis may still be stolen since the modular ski rack itself can be removed and stolen together with the skis. This is made possible since the mounting bolts which attach the ski rack to an attachment surface are easily accessible and can be easily removed. Thus, the device of '007 patent only offers minimum protection against theft.

Similarly, U.S. Pat. No. 3,568,902 to Highberger and U.S. Pat. No. 5,147,049 to Schwendemann et al. disclose devices for securing and for carrying skis along their mid-section including an integral lock. Whereas these devices were primarily designed to secure the skis and allow carrying of the skis, embodiments are disclosed where these devices can be mounted to a fixed structure to allow use as a storage device. These devices are U-shaped brackets and include a swinging arm which can be opened and closed so that the skis can be retained in the U-shaped brackets. However, these devices are also limited in their ability to adequately secure skies having different shapes and dimensions such as their thickness and width dimensions. In addition, these designs have been found to be expensive to manufacture because of their complexity and the uniqueness of the numerous components used. Furthermore, because these designs were made for portable use, they require special and cumbersome bracketing in order to mount them on a surface such as a wall. Moreover, even these devices have exposed mounting bolts and other fasteners which hold the devices together which allows removal of these devices from an attachment surface or allow disassembly thereby allowing a thief to steal the skis stored therein. Therefore, such devices have not gained wide acceptance by consumers for use as ski storage devices.

Therefore, there exists an unfulfilled need for a ski storage device including a lock which will prevent theft of the skis stored therein. There also exists an unfulfilled need for such a ski storage device which cannot be easily removed from an attachment surface when skis are stored. In addition, there exists an unfulfilled need for a ski storage device which will allow storage of skis having different shapes and dimensions. In particular, there exists an unfulfilled need for such a ski storage device which will allow storage of skis having different thicknesses and widths. Moreover, there also exists an unfulfilled need for such a ski storage device which is inexpensive and relatively simple to manufacture.

SUMMARY OF THE INVENTION

In view of the foregoing, it is an object of the present invention to provide an improved a ski storage device including a lock which will prevent theft of the skis stored therein.

A second object of the present invention is to provide an improved a ski storage device which cannot be easily removed from an attachment surface when skis are stored therein.

Yet another object of the present invention is to provide such a ski storage device which will allow storage of skis having different shapes and dimensions.

A fourth object of the present invention is to provide such a ski storage device which will allow storage of skis having different widths and thicknesses.

Still further, it is an object of the present invention to provide such a ski storage device which is inexpensive and relatively simple to manufacture.

In accordance with one embodiment of the present invention, these objects are obtained by an improved ski storage device including a back plate adapted to be mounted to an attachment surface, a first side panel outwardly extending away from the back plate, a second side panel outwardly extending away from the back plate and being positioned a spaced transverse distance from the first side panel thereby forming a substantially U-shape with a transverse gap between the first and second side panels for storing skis therein, each of the first and second side panels including a first end attached to the back plate and a free distal end located away from the back plate which form a transverse opening for receiving skis to be stored in the transverse gap, and a mounting means positioned in the back plate between the first and second side panels in a manner that the mounting means is inaccessible when skis are stored in the ski storage device. In one embodiment of the present invention, the mounting means includes at least one mounting aperture adapted to receive a mounting fastener to allow secure attachment of the back plate to an attachment surface. The ski storage device in accordance with one embodiment of the present invention further includes further include a lock to prevent unauthorized removal of the skis stored therein, the lock being positioned on the first side panel and including a lock tab which extends across the transverse opening to engage the second side panel when the lock is in a locked position thereby at least partially blocking access to the transverse gap. The lock tab preferably includes a bent portion at one end, the lock tab being pivotable into a lock tab cut-out adapted to receive the lock tab in the first side panel when the lock is in an unlocked position and being pivotable so that the bent portion enters a lock tab slot provided in the second side panel when the lock is in a locked position. The ski storage device in accordance with the present embodiment preferably also includes a retainer adapted to retain trailing ends of skis stored in the ski storage device, the retainer including a mounting hole disposed between bolt tabs which engage a head of a retainer bolt, thus requiring rotation of the retainer to thread the retainer bolt into an attachment surface.

In another embodiment of the present invention, the first side panel and the second side panel are adapted to be variably adjusted between a retracted position and an elongated position, the first side panel and the second side panel extending further away from the back plate when in the elongated position than in the retracted position. In this regard, the first side panel and the second side panel in accordance with one embodiment preferably includes a support panel secured to the back plate and an extension panel supported on the support panel, the extension panel being adapted to adjust the first side panel and the second side panel between the retracted position and the elongated position. The support panel is preferably nested within the extension panel and the extension panel is preferably supported to the support panel by an adjusting fastener which is accessible only when the support panel is removed from the back plate. Moreover, the back plate preferably includes an extending arm which extends to the adjusting fastener to ensure proper seating of the adjusting fastener and to prevent unintended retraction of the extension panel. This embodiment of the present invention preferably also includes a lock described previously to prevent unauthorized removal of the skis stored therein.

In yet another embodiment of the present invention, at least one of the first side panel and the second side panel is adjustably secured to the back plate to allow adjustment of the transverse distance between the first side panel and the second side panel to adjust the transverse gap. In this regard, the back plate preferably includes a slotted aperture that receives a securing fastener which secures at least one of the first side panel and the second side panel to the back plate in a manner to allow adjustment of the transverse distance between the first side panel and the second side panel to adjust the transverse gap. The securing fastener may be positioned to be accessible only when the back plate is detached from an attachment surface. Of course, this embodiment of the present invention preferably also includes a lock described previously to prevent unauthorized removal of the skis stored therein.

These and other objects, features and advantages of the present invention will become more apparent from the following detailed description of the preferred embodiments of the invention when viewed in conjunction with the accompanying drawings.

DETAILED DESCRIPTION OF THE INVENTION

Figure 1:
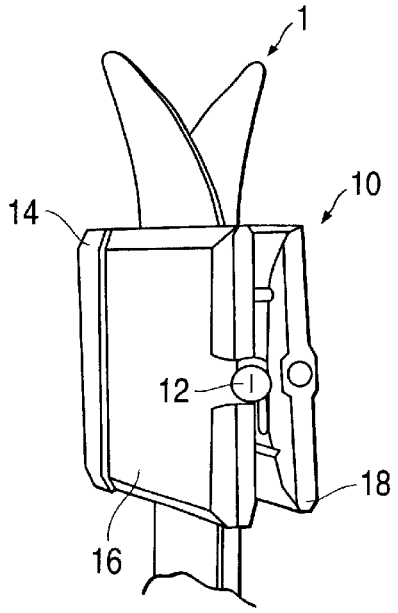
FIG. 1 is a perspective view of the ski storage device in accordance with one embodiment of the present invention mounted to an attachment surface such as a wall with a pair of standard skis stored in the ski storage device.

FIG. 1 illustrates one embodiment of the present invention which will accomplish the above noted objectives. The ski storage device 10 of the illustrated embodiment includes a lock 12 which will prevent theft of the skis 1 stored therein. As will be discussed further below, the illustrated embodiment of the ski storage device 10 cannot be easily removed from an attachment surface such as a wall (not shown) when the skis 1 are stored therein. In addition, the ski storage device 10 in the illustrated embodiment allows storage of skis having different shapes and dimensions and is inexpensive and relatively simple to manufacture. These objects are obtained by an improved ski storage device 10 of FIGS. 1 to 11 which incorporates numerous features not known in the prior art. It is preliminarily noted that all of these features need not be provided in order to practice the present invention but an embodiment of the present invention having all these features is discussed in detail hereinbelow for simplicity and clarity.

Figure 2:
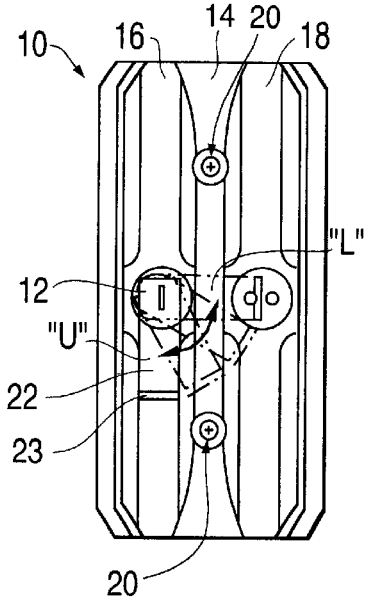
FIG. 2 is a front view of the ski storage device of FIG. 1 with the skis removed and the lock tab being pivoted from an unlocked position to a locked position.
Figure 3:
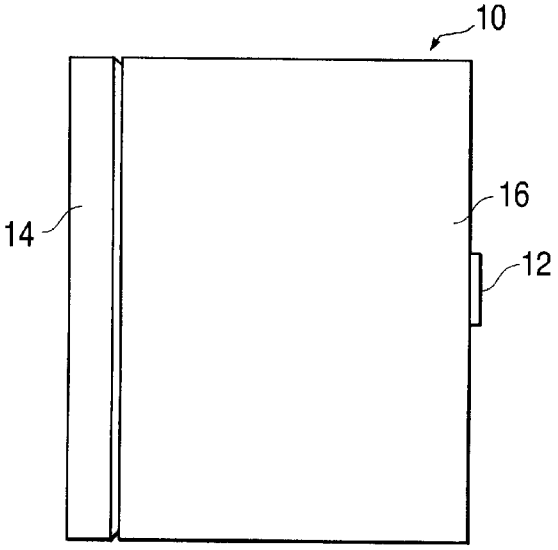
FIG. 3 is a side view of the ski storage device of FIG. 2.

As can be seen in FIGS. 1 to 4, the ski storage device 10 in accordance with one embodiment of the present invention includes a back plate 14 which is adapted to be mounted to an attachment surface such as a wall (not shown). The ski storage device 10 also includes a first side panel 16 and a second side panel 18, both of which outwardly extend away from the back plate 14 in the manner best illustrated in FIGS. 1 and 4. It should be initially noted that the terms "first side panel" and "second side panel" are used hereinbelow in a more generic sense to indicate structural panels that support the skis stored therein between. In particular, in the illustrated embodiment of FIG. 4, these first side and second side panels can be understood to mean single unitary panels which are directly attached to the back plate 14. However, in other embodiments as discussed further below, these first side and second side panels can be understood to mean assemblies which include support panels (not shown) which allow adjustability of the side panels. As can be best seen in FIG. 4, the second side panel 18 is positioned at a spaced transverse distance "d" along the back plate 14 from the first side panel 16 in a manner that the ski storage device has a substantially U-shape and is provided with a transverse gap "g" for storing the skis therein. Each of the first and second side panels 16 and 18 are attached to the back plate 14 at one end and have a free distal end 19 (and 19') forming a transverse opening "o" for receiving the skis 1 into the transverse gap g. As can be seen in FIG. 1 of this embodiment, the transverse gap g is adapted to receive skis therein and to support the tips of the skis while maintaining the trailing ends of the skis off the floor thereby allowing storage of skis 1 in the ski storage device 10. In addition, the present embodiment includes a mounting means positioned in the back plate 14 between the first side panel 16 and the second side panel 18 in a manner that the mounting means is inaccessible when the skis 1 are stored in the ski storage device 10. One embodiment of such mounting means preferably includes mounting apertures 20 as illustrated in FIG. 2 which are adapted to receive a mounting fastener 21 (not shown) to allow secure attachment of the back plate 14 to an attachment surface such as a wall (not shown). The mounting aperture 20 in the present embodiment, is positioned between the first side panel 16 and the second panel 18 in the transverse gap g in a manner that a mounting fastener (not shown) would be inaccessible when skis 1 are stored in the ski storage device 10. Thus, this limited access prevents the removal of the ski storage device 10 when it is mounted to an attachment surface and skis are stored in the ski storage device 10. Of course, the mounting means may be some other fasteners or mounting apparatus such as bracketing, clips, etc.

As illustrated in FIGS. 1 to 4, the ski storage device 10 preferably further includes a lock 12 to prevent unauthorized removal of the skis 1 stored therein. The lock is positioned on the distal end 19 of the first side panel 16 and include a lock tab 22 which is illustrated in FIG. 2 are being pivoted from an unlocked position "U" to a locked position "L" where it engages the second side panel 18. Because the lock tab 22 extends across the transverse opening o to engage the second side panel 18 when the lock 12 is in a locked position "L", access to the transverse opening o is at least partially blocked by the lock tab 22 thereby prohibiting the removal of the skis 1 stored in the transverse gap g. The lock tab 22 preferably includes a bent portion 23 at one end, the lock tab 22 being pivotable into a lock tab cut-out (not shown) adapted to receive the lock tab 22 in the first side panel 16 when the lock 12 is in an unlocked position "U" and being pivotable so that the bent portion enters a lock tab slot (not shown) provided in the second side panel 18 when the lock 12 is in a locked position "L". It should be readily apparent that when skis 1 are stored and locked within the transverse gap g by the lock tab 22, the mounting aperture 20 and the mounting fastener received therein becomes inaccessible until the skis 1 are removed, which of course, requires that the lock 12 be unlocked. Thus, in this manner, the ski storage device 10 in accordance with the present embodiment, can prevent unauthorized removal of the skis 1 and the storage device 10 which was not possible in the prior art devices. Of course, in alternative embodiments, the lock 23 may be provided on the second side panel 18 and more than one lock can also provided on either side panels as desired.

Figure 4:
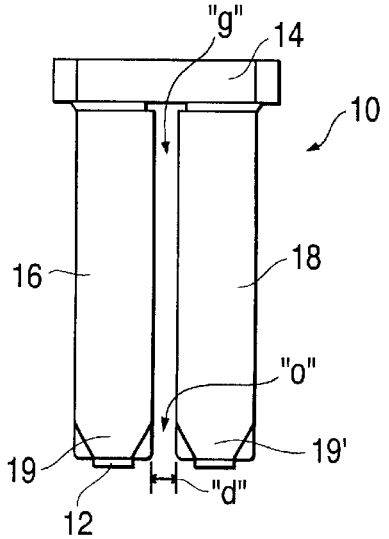
FIG. 4 is a top view of the ski storage device of FIG. 2.
Figure 5:
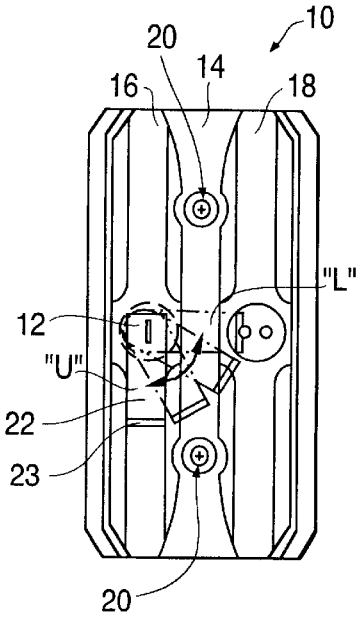
FIG. 5 is a front view of the ski storage device of FIG. 2 but with the first side panel and the second side panel in an extended position with the transverse gap widened.
Figure 6:
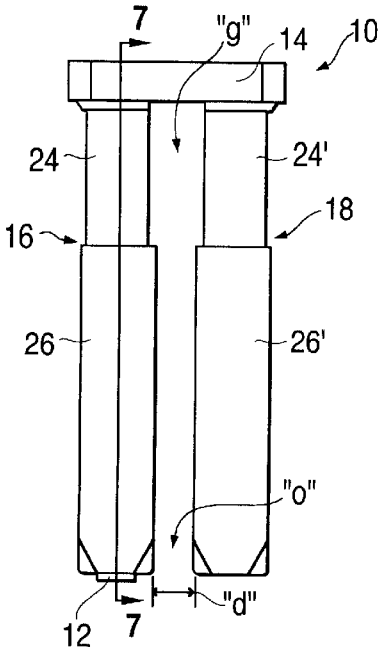
FIG. 6 is a top view of the ski storage device of FIG. 5.

As will be discussed in further detail below, FIGS. 5 and 6 illustrate the ski storage device 10 in accordance with another embodiment of the present invention with the first side panel 16 and the second side panel 18 in an extended position with the transverse gap g widened. As can be more clearly seen by comparing FIG. 4 with FIG. 6, the first side panel 16 and the second side panel 18 of the ski storage device 10 in accordance with the present embodiment are adapted to be variably adjusted between a retracted position (FIG. 4) and an elongated position (FIG. 6). As can be seen, the first side panel 16 and the second side panel 18 extend further away from the back plate 14 when in the elongated position than in the retracted position. In this regard, the first side panel 16 and the second side panel 18 preferably includes support panels 24 and 24' secured to the back plate 14 and extension panels 26 and 26'. As can be appreciated, the components of the first side panel 16 are merely enumerated whereas the corresponding components of the second side panel 18 are indicated with same numerals with a prime designation. The extension panels 26 and 26' are supported on the support panels 24 and 24' respectively and are adapted to variably adjust the first side panel 16 and the second side panel 18 between the retracted position (FIG. 4) and the elongated position (FIG. 6). This adjustability of the first side panel 16 and the second side panel 18 between a retracted position (FIG. 4) and an elongated position (FIG. 6) allows the ski storage device 10 of the present embodiment to accommodate different skis having different width dimensions including standard skis, cross country skis, shaped (parabolic) skis, "Fat Boys", ski skates and ski boards, etc. which was not possible in prior art devices. In addition, the variable adjustability of the side panels also allows storage of other ski equipment such as ski poles together with the skis. In the present illustrated embodiment, first and second side panels 16 and 18 are variably adjustable to extend outwardly from the back plate 14 between substantially 5 inches to substantially 7 inches. Of course, other embodiments may allow more or less adjustability.

In addition, as can also be seen by comparing FIG. 4 with FIG. 6, the first side panel 16 and the second side panel 18 are adjustably secured to the back plate 14 to allow variable adjustment of the transverse distance between the first side panel 16 and the second side panel 18 thereby adjusting the transverse gap g. As can be seen in FIG. 4, the transverse distance between the first side panel 16 and the second side panel 18 is indicated as "d" which is smaller than the transverse distance shown in FIG. 6 indicated as "D". This adjustability of the transverse gap g (and correspondingly, the transverse opening o) anywhere between the minimum distance d and maximum distance D allows the ski storage device of the present embodiment to accommodate skis having different thickness dimensions such as the various types of skis noted above. In the present illustrated embodiment, the transverse gap g is variably adjustable between substantially ⅜ inch to substantially ⅞ inch. Of course, other embodiments may allow more or less adjustability.

Figure 7:
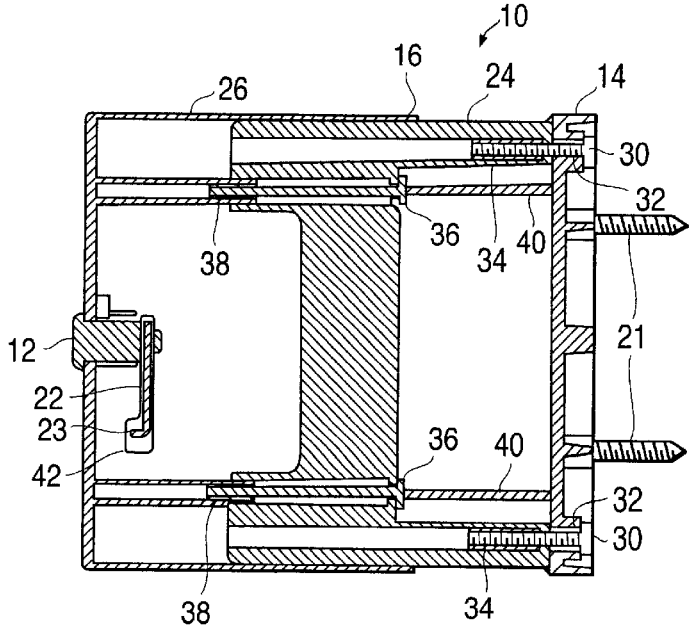
FIG. 7 is a cross-sectional side view of the ski storage device of FIG. 6 as viewed along 7—7.

The detailed construction of the present embodiment is more clearly shown in FIG. 7 which is cross-sectional side view of the ski storage device 10 viewed along 7—7 of FIG. 6. As can be seen, the support panel 24 is secured to the back plate 14 by securing fasteners 30. In this regard, the back plate 14 preferably includes slotted apertures 32 that receives the securing fasteners 30 which threadingly engage a securing insert 34 provided in the support panel 24. The securing fasteners 30 in turn, secures the support panel 24 of the first side panel 16 to the back plate 14 in a manner to allow adjustment of the transverse distance between the first side panel 16 and the second side panel 18 as previously described relative to FIGS. 4 and 6 thereby adjusting the transverse gap g. It should be readily apparent that the securing fasteners 30 are positioned in the present embodiment such that they are inaccessible when the back plate 14 is attached to an attachment surface by mounting fasteners 21 and are accessible only when the back plate 14 is detached from an attachment surface such as a wall.

FIG. 7 also illustrates that the support panel 24 is preferably nested within the extension panel 26 and the extension panel 26 is preferably supported to the support panel 24 by an adjusting fasteners 36 which threadingly engage adjustment insert 38 provided in the extension panel 26. As can be appreciated, the adjusting fasteners 36 are positioned to be accessible only when the support panel 24 is removed from the back plate 14. Moreover, the back plate 14 preferably includes extending arms 40 which extend to the adjusting fasteners 36 to ensure proper seating of the adjusting fastener 36 and to prevent unintended retraction of the extension panel 26.

Figure 8:
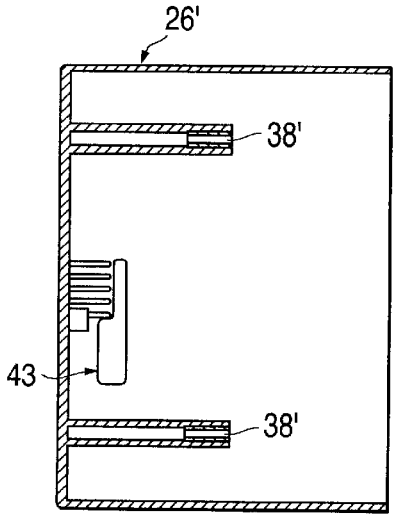
FIG. 8 is a cross-sectional side view of the second side panel.

In addition, FIGS. 7 and 8, clearly illustrate the positioning and the operation of the lock 12. In this embodiment, the lock 12 is preferably be positioned on the distal end 19 of the first side panel 16 and is pivoted from an unlocked position to a locked position where it engages the second side panel 18. In the present embodiment, because the first side panel 16 can be variably adjusted, the lock 12 is provided on the extension panel 26. The lock tab 22 of the lock 12 is pivotable out of the extension panel 26 through a lock tab cut-out 42 in the extension panel 26 so that when the lock 12 is in the unlocked position "U", the lock tab 22 is housed within the extension panel 26 and does not block the transverse opening o or impede accessibility to the transverse gap g. When skis 1 are to be securely stored in the ski storage device 10, the lock tab 22 is pivotable into a lock position "L" where the bent portion 23 of the lock tab 22 enters a lock tab slot 43 provided in the extension panel 26' of the second side panel 18 illustrated in FIG. 8. Because the lock tab 22 extends across the transverse opening o to engage the extension panel 26' when the lock 12 is in a locked position "L", access to the transverse gap g is at least partially blocked by the lock tab 22 thereby prohibiting the removal of the skis 1 stored therein.

Figure 9:
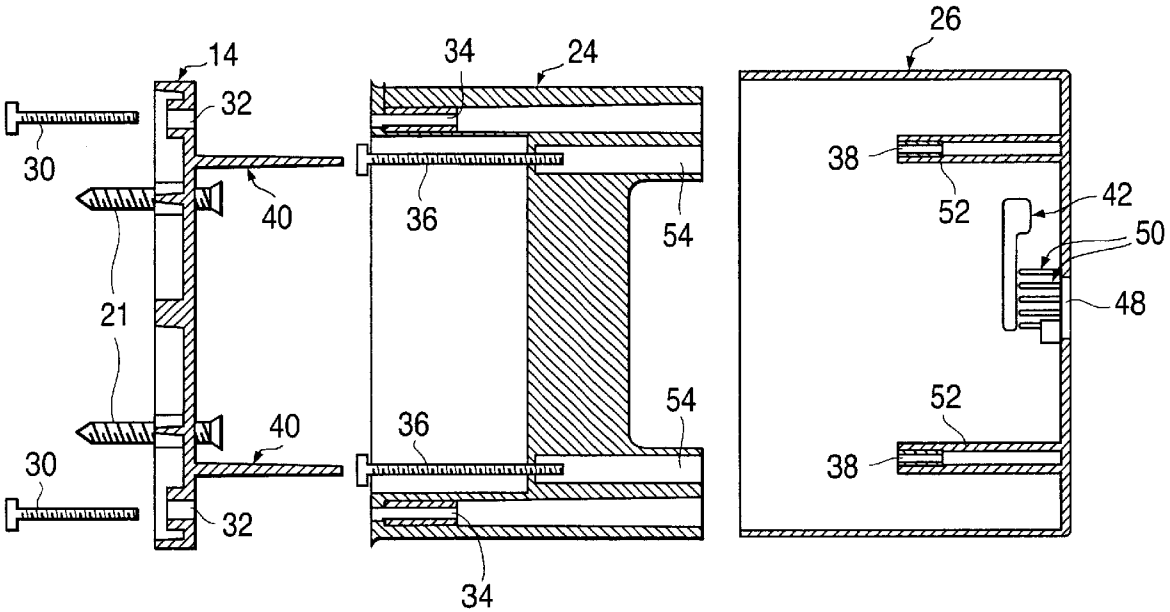
FIG. 9 is an exploded view of the cross-section of FIG. 7.
Figure 10:
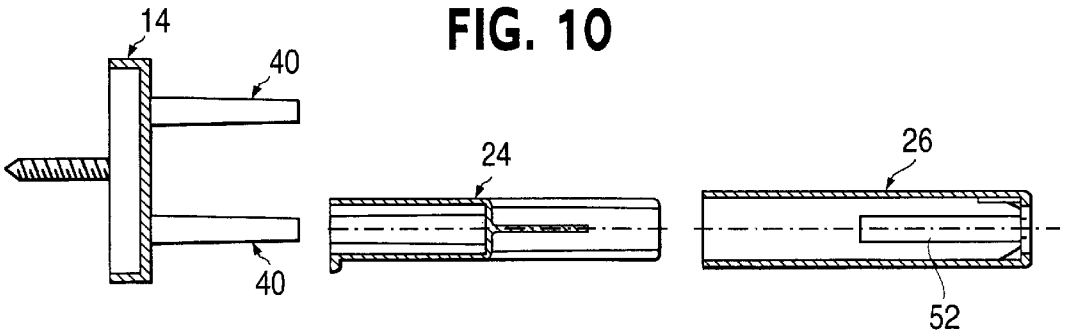
FIG. 10 is a top cross section view of exploded view of FIG. 9.

FIGS. 9 and 10 provide disassembled views of the first side panel 16 with the lock 12 removed for clarity. FIG. 10 shows a top cross sectional view of FIG. 9 with securing fasteners 30 and the adjusting fasteners 36 removed for further clarity. As can be seen, especially from FIG. 9, the various components of the ski storage device 10 in accordance with the illustrated embodiment is preferably assembled in the following manner. Initially, a lock 12 is inserted into the lock hole 48 of the extension panel 26 such that the lock tab 22 is positioned within the extension panel 26 and aligned with the lock tab cut-out 42 to allow pivoting of the lock tab 22 out of the extension panel 26. The lock 12 and the extension panel 26 is preferably designed to securely hold the lock 12 in the lock hole 48 of the extension panel 26 which preferably includes reinforcing ribs 50 for added strength in the area of the lock hole 48. The securement of the lock 12 in the lock hole 48 is attained by providing a lock spring (not shown) on the lock 12 which fixedly engages the lock hole 48 of the extension panel 26.

The support panel 24 is inserted within the extension panel 26 such that the extension panel guides 52 are received within receiving guides 54 of the support panel 24. The two adjusting fasteners 36 are then threadingly engaged to the adjustment insert 38 provided on the extension panel guides 52. As can be readily appreciated, the position of the extension panel 26 relative to the support panel 24 can be adjusted by simply adjusting the amount that the adjusting fasteners 36 are threaded into the extension panel guides 52. Thus, by adjusting the relative positioning between the extension panel 26 and the support panel, the extension of the first side panel 16 is also adjusted. The more the adjusting fasteners 36 are threaded into the extension panel guides 52, the extension panel 26 is retracted from an elongated position to a retracted position. Typically, the proper extension of the extension panels 26 may be determined by laying the tip of the ski to be stored on the first side panel 26 and threading the adjusting fasteners 36 until there is a minimum of substantially ¼ inch from the edge of the ski to the lock tab cut-out 42. It should be noted that the adjustment inserts 38 need not be provided separately on the extension panel guides 52 but instead, be integrally formed within the extension panel guides 52. However, in the present illustrated embodiment, most of the components, including the back plate 14, the support panels 24 and 24' as well as the extension panels 26 and 26' are made of plastic. Thus, it is desirable to use such inserts to improve operation of the ski storage device 10 and to increase the strength of these components by using such inserts. Of course, it should also be noted that other materials may be easily used in making the components of the ski storage device 10 including various metals and composite materials.

The second side panel 18 is adjusted in the same manner by comparing the amount of extension of the extension panel 26' relative to the support panel 24' so that the extension of the two side panels 16 and 18 are substantially the same. This ensures proper alignment of the lock tab cut-out 42 with the lock tab slot 43 to allow proper operation of the lock 12 and proper engagement of the lock tab 22 with the lock tab slot 43. In the present embodiment, most skis will fit in the first and second side panels 16 and 18 even if they are in a retracted position of FIG. 4. If the skis to be stored are dimensioned with wide tips such as shaped skis, or simultaneous storage of ski poles (not shown) is desired, the first and second side panels 16 and 18 may be extended correspondingly to allow such storage of skis and/or ski poles. As previously noted, in the present embodiment, the first and second side panels 16 and 18 are variably adjustable between substantially 5 inches to substantially 7 inches to allow adjustable use of the ski storage device 10.

These assembled first side panel 16 and the second side panel 18 are then secured to the back plate 14 using securing fasteners 30. As the first and second side panels 16 and 18 are secured on to the back plate 14, the extending arms 40 of the back plate 14 extend to the adjusting fasteners 36 and pushes and maintains the adjusting fasteners in a proper seated position thereby preventing unintended retraction of the extension panel 26. The securing fasteners 30 are positioned through the slotted apertures 32 of the back plate 14 and are threadingly engaged to a securing insert 34 provided in the support panel 24 thereby tightly securing the first and second side panels 16 and 18 to the back plate 14. Again, the securing inserts 34 need not be provided separately on the support panel 24 but instead, be integrally formed within the support panel 24 itself.

Figure 11:
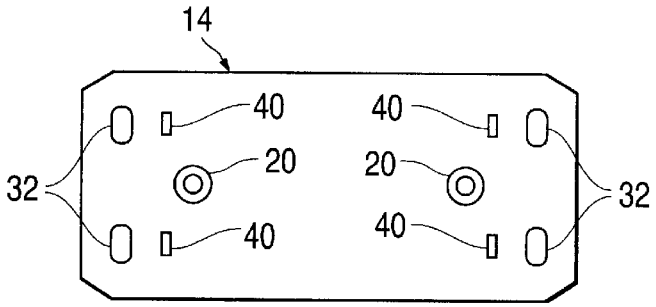
FIG. 11 is a top view of the back plate in accordance with one embodiment of the present invention.

The shape of the slotted apertures 32 are better illustrated in FIG. 11 which shows a frontal view of the back plate 14. Because the slotted apertures 32 are slotted, the securing fasteners 30 are laterally adjustable therein prior to the tight securing of the support panels 24 and 24' to the back plate 14. As previously noted, this allows the adjustment of the transverse distance between the first side panel 16 and the second side panel 18 thereby allowing adjustment of the transverse gap g and allowing storage of skis having different thickness dimensions. The appropriate transverse distance may be easily determined by inserting the skis to be stored into the transverse gap g and then, adjusting the positions of the first side panel 16 and the second side panel 18 so that the skis fit snugly in the transverse gap g. In addition, the slotted apertures 32 may in another embodiment also include an abutment (not shown) to limit the adjustability of the transverse gap g. Such limitation may be desirable if the locking tab 22 of the lock 12 is of limited dimension such that maximum widening of the transverse gap g may be too wide for the curved portion 23 of the locking tab 22 to engage the lock tab slot 43 on the second side panel 18. As previously noted, the transverse gap g is adjustable between substantially ⅜ inch to substantially ⅞ inch in the presently described embodiment. Once the securing fasteners 30 are fully tightened into the securing insert 34 of the support panels 24 and 24', the assembly of the ski storage device 10 is complete so that it can be mounted on a mounting surface such as a wall or a ceiling.

The completely assembled ski storage device 10 can then be mounted in the manner shown in FIG. 1 using the mounting fasteners 21 and be used to securely store skis 1 therein. It should be apparent that the above discussed embodiment of the present invention provides a ski storage device 10 which cannot be easily removed from an attachment surface such as a wall or a ceiling when the skis are stored therein. As previously noted in reference to FIG. 7, the adjusting fasteners 36 are accessible only when the support panels 24 and 24' are removed from the back plate 14 and the securing fasteners 30 are accessible only when the back plate 14 itself is detached from an attachment surface such as a wall. Only the mounting fasteners 21 are accessible when the ski storage device 10 is mounted to a mounting surface. However, as previously described, when skis 1 are locked within the ski storage device 10, the access to the mounting fasteners 21 is also restricted. Thus, when the ski storage device 10 is mounted and skis are locked therein, there are no fasteners on the exterior of the ski storage device 10 which is readily accessible to a thief. Thus, the skis 1 and the ski storage device 10 cannot be easily stolen when the skis 1 are locked within the ski storage device 10.

Figure 12:
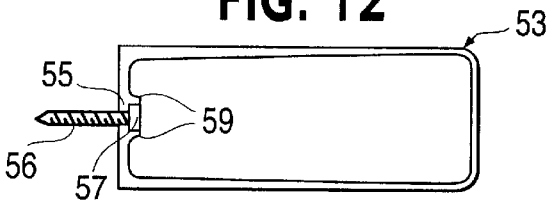
FIG. 12 is a top view of a retainer in accordance with one embodiment of the present invention.
Figure 13:
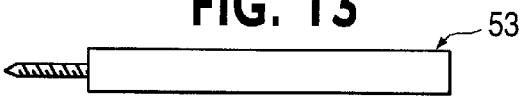
FIG. 13 is a side view of the retainer of FIG. 12.
Figure 14:
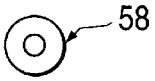
FIG. 14 is a front view of a washer which may be used in mounting the retainer of FIG. 12.

In addition to the above components, the ski storage device 10 may be used in conjunction with a retainer 53 as shown in FIGS. 12 and 13 which is adapted to retain trailing ends of skis stored in the ski storage device 10. The retainer 53 includes a mounting hole 55 disposed between bolt tabs 59 which engage a head 57 of a retainer bolt 56, thus requiring rotation of the retainer 53 to thread the retainer bolt 56 into an attachment surface such as a wall. In this regard, a flat washer 58 shown in FIG. 14 is adapted to be inserted on the retainer bolt 56 so that it acts as a bearing surface between the attachment surface and the retainer 53. The retainer 53 is preferably mounted relative to the ski storage device 10 in the manner illustrated in FIG. 15 which clearly shows how skis can be securely stored on a wall. In this illustrated embodiment, the retainer 53 generally functions to ensure that the trailing end of the stored skis stay together and do not become separated from one another. This ensures that the curved tips of the leading end of each ski points outwardly such that the curved tips are retained by the first and second side panels 16 and 18 of the ski storage device 10. In addition, the retainer provides additional security in the storage of skis since the retainer 53 will resist any attempts to remove the skis. Moreover, the retainer 53 cannot be readily removed from the attachment surface when skis are stored therein because the bolt tabs 59 which engage the head 57 of the retainer bolt 56 necessitates the rotation of the retainer 53 in order to unthread the retainer bolt 56 from an attachment surface. However, such rotation is made impossible because of the skis stored therein. Thus, skis would have to be removed before the retainer can be removed from the attachment surface which is only possible by unlocking the lock 12 of the ski storage device 10.

Figure 15:
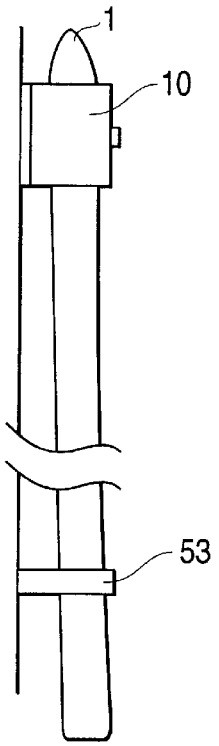
FIG. 15 is a side profile view of one embodiment of the present invention mounted on an attachment surface such as a wall.
Figure 16:
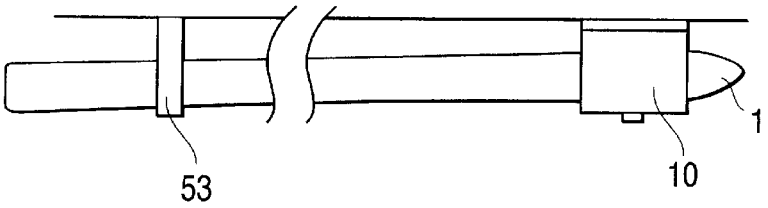
FIG. 16 is a side profile view of one embodiment of the present invention mounted on an attachment surface such as a ceiling.

In addition, the retainer 53 also allows the ski storage device 10 to be used such that the skis may be mounted in various positions. Whereas FIG. 15 illustrates the mounting of the ski storage device 10 on a vertical wall with skis being stored in a vertical orientation, FIG. 16 clearly illustrates how the retainer 53 may be used with the ski storage device 10 to allow mounting of skis on an overhead ceiling surface. Of course, the storage device 10 and the retainer 53 may alternatively be mounted on a vertical wall so that skis are stored in a lateral orientation as well. It should be further noted that if the present ski storage device 10 is to be mounted on a drywall surface, an appropriate anchor may be necessary to increase the load carrying capacity of the drywall surface.

The ski storage device 10 in accordance with the above illustrated embodiment can also be provided with a weather cap (not shown) which is adapted to be mounted to the lock 12 so as to keep moisture out of the lock and thus, allow outdoor use of the ski storage device 10 such as in ski slopes. The weather cap (not shown) may include a flip door which is adapted to be snapped over the lock 12.

Figure 17:
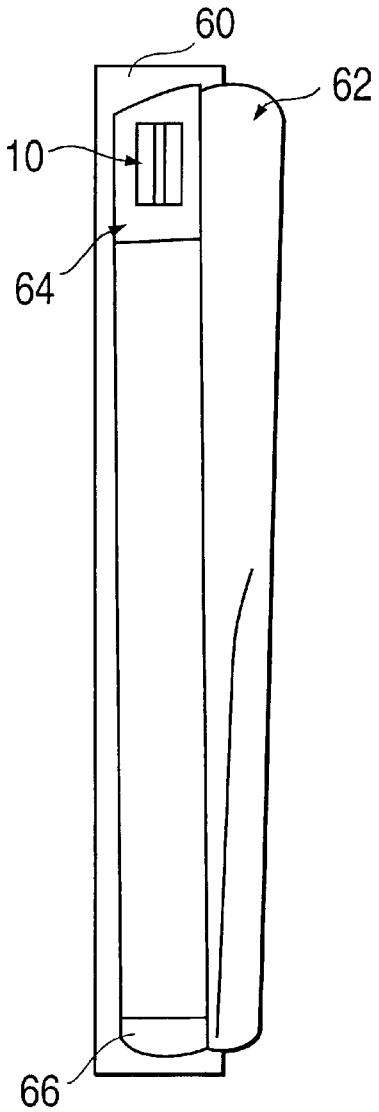
FIG. 17 is a front view of one embodiment of the present invention used in conjunction with a locker.
Figure 18:
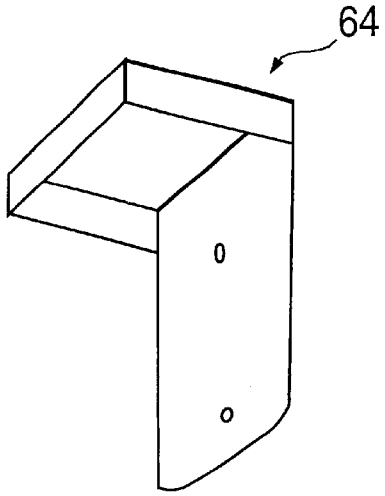
FIG. 18 is a perspective view of one embodiment of an upper pan which may be used with the locker of FIG. 17.
Figure 19:
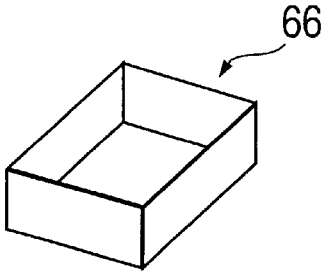
FIG. 19 is a perspective view of one embodiment of a lower pan which may be used with the locker of FIG. 17

In addition, the ski storage device 10 may be used in conjunction with a locker 60 in accordance with another embodiment of the present invention as shown in FIG. 17. The locker 60 may be provided with a zippered access door 62 and be dimensioned to store skis therein. The locker 60 may be made from a vinyl material and have meshed sides to allow ventilation of the locker 60 thereby facilitating evaporation of any snow, water or moisture which may be present in the ski equipment stored therein. In this regard, the locker 60 preferably includes an upper pan 64 as more clearly shown in FIG. 18 which provides a mounting surface for the ski storage device 10 and also gives structural support to the locker 60. The locker 60 preferably also be provided with a lower pan 66 as more clearly shown in FIG. 19 which gives further structural support to the locker 60 and also serves as a collection pan to collect water and snow falling from the stored ski. The upper pan 64 and the lower pan may be made of plastic, metal or other materials.

From the foregoing, it should now be apparent how the present invention affords such a ski storage device including a lock which will prevent theft of the skis stored therein. In addition, it can be seen how the present invention provides an improved ski storage device which cannot be easily removed from an attachment surface when skis are stored therein. Furthermore, it can be seen how the present invention provides an improved ski storage device which will allow storage of skis having different widths and thicknesses. Moreover, it can also be seen how the present invention provides an improved ski storage device which is inexpensive and relatively simple to manufacture.

While various embodiments in accordance with the present invention have been shown and described, it is understood that the invention is not limited thereto. These embodiments may be changed, modified and further applied by those skilled in the art. In particular, as previously noted, the above illustrated embodiment includes all the various features described. However, the present invention may still be practiced by including one or more of the features described. Therefore, this invention is not limited to the details shown and described previously but also includes all such changes and modifications which are encompassed by the appended claims.

What is claimed is:

1. A ski storage device comprising:

a back plate adapted to be mounted to an attachment surface;

a first side panel outwardly extending away from said back plate;

a second side panel outwardly extending away from said back plate and being positioned a spaced transverse distance along said back plate from said first side panel thereby forming a substantially U-shape with a transverse gap between said first side panel and said second side panel for storing skis therein, each of said first side panel and said second side panel including a first end attached to said back plate and a free distal end located away from said back plate, said free distal end of each of said first side panel and said second side panel forming a transverse opening for receiving skis to be stored in said transverse gap, at least one of said first side panel and said second side panel being adjustably secured to said back plate to allow adjustment of said transverse gap, and said first side panel and said second side panel each comprising at least first and second slidably interconnected members, said panels being adapted to be variably adjusted between a retracted position and an elongated position, said free distal ends of said first side panel and said second side panel extending further away from said back plate and said attachment surface when in said elongated position than in said retracted position; and a mounting means positioned in said back plate between said first side panel and said second panel in a manner that said mounting means is inaccessible when skis are stored in said ski storage device.

2. A ski storage device of claim 1, further comprising a lock to prevent unauthorized removal of the skis stored therein, said lock being positioned on said first side panel and including a lock tab which extends across said transverse gap to engage said second side panel when said lock is in a locked position thereby at least partially blocking access to said transverse gap.

3. A ski storage device of claim 2, further comprising a retainer adapted to retain trailing ends of skis stored in said ski storage device, said retainer including a mounting hole disposed between bolt tabs which engage a head of a retainer bolt, thus requiring rotation of said retainer to thread said retainer bolt into an attachment surface.

4. A ski storage device of claim 1, wherein said mounting means includes at least one mounting aperture adapted to receive a mounting fastener which securely attaches said back plate to the attachment surface.

5. A ski storage device of claim 2, wherein said first side panel and said second side panel are secured to said back plate with securing fasteners which are accessible only when said back plate is detached from the attachment surface.

6. A ski storage device of claim 2, wherein said first side panel and said second side panel are secured to said back plate with securing fasteners which are accessible only when said back plate is detached from the attachment surface.

7. A ski storage device comprising:

a back plate adapted to be mounted to an attachment surface;

a first side panel outwardly extending away from said back plate;

a second side panel outwardly extending away from said back plate and being positioned a spaced transverse distance along said back plate from said first side panel thereby forming a substantially U-shape with a transverse gap between said first side panel and said second side panel for storing skis therein, each of said first panel and said second side panel including a first end attached to said back plate and a free distal end located away from said back plate, said free distal end of each of said first side panel and said second side panel forming a transverse opening for receiving skis to be stored in said transverse gap; and wherein said first side panel and said second side panel each include a support panel secured to said back plate and an extension panel slidably supported on said support panel which are adapted to allow variable slidable adjustment of said first side panel and said second side panel between a retracted position and an elongated position, said first side panel and said second side panel extending further away from said back plate and said attachment surface when in said elongated position than in said retracted position, said support panels being secured to said back plate by securing fasteners which are inaccessible when said back plate is mounted to the attachment surface.

8. A ski storage device of claim 7, wherein said extension panel is supported to said support panel by an adjusting fastener which is accessible only when said support panel is removed from said back plate.

9. A ski storage device of claim 8, wherein said back plate includes an extending arm which extends to said adjusting fastener to ensure proper seating of said adjusting fastener and to prevent unintended retraction of said extension panel.

10. A ski storage device of claim 7, further comprising a lock to prevent unauthorized removal of the skis stored therein, said lock being positioned on said first side panel and including a lock tab which extends across said transverse gap to engage said second side panel when said lock is in a locked position thereby at least partially blocking access to said transverse gap.

11. A ski storage device of claim 10, wherein said lock tab includes a bent portion at one end, said lock tab being pivotable into a lock tab cut-out adapted to receive said lock tab in said first side panel when said lock is in an unlocked position and being pivotable so that said bent portion enters a lock tab slot provided in said second side panel when said lock is in a locked position.

12. A ski storage device of claim 7, wherein said back plate includes slotted apertures that receive securing fasteners which secure said first side panel and said second side panel to said back plate in a manner to allow adjustment of said transverse distance between said first side panel and said second side panel to adjust said transverse gap.

13. A ski storage device of claim 12, wherein said securing fasteners are accessible only when said back plate is detached from the attachment surface.

14. A ski storage device of claim 7, wherein said support panel is nested within said extension panel.

* * * * *